United States Patent [19]

Blankemeyer

[11] Patent Number: 4,643,815

[45] Date of Patent: Feb. 17, 1987

[54] ELECTROCOATING METHOD AND APPARATUS

[75] Inventor: Robert L. Blankemeyer, Fort Jennings, Ohio

[73] Assignee: Metokote Corporation, Lima, Ohio

[21] Appl. No.: 676,882

[22] Filed: Nov. 30, 1984

[51] Int. Cl.[4] ..... C25D 13/00; C25D 13/24

[52] U.S. Cl. ..... 204/180.2; 204/180.8; 204/182.4; 204/299 EC; 204/301; 204/181.7

[58] Field of Search ..... 204/180.8, 181.7, 182.4, 204/299 EC, 301, 282, 283, 180.2

[56] References Cited

U.S. PATENT DOCUMENTS

| | | | |
|---|---|---|---|
| 3,444,065 | 5/1969 | Strosberg | 204/180.8 |
| 3,496,082 | 2/1970 | Orem et al. | 204/180.8 |
| 3,620,955 | 11/1971 | Jones | 204/180.8 |
| 3,671,412 | 6/1972 | Lohr | 204/180.8 |
| 3,784,460 | 1/1974 | LeBras et al. | 204/182.4 |
| 3,865,706 | 2/1975 | Cooke | 204/180.8 |
| 4,105,534 | 8/1978 | Beatty, III | 204/301 |
| 4,229,280 | 10/1980 | Horn | 204/301 |
| 4,284,493 | 8/1981 | Case et al. | 204/180.8 |
| 4,445,984 | 5/1984 | Tiron | 204/301 |
| 4,537,672 | 8/1985 | Brereton | 204/282 |

OTHER PUBLICATIONS

Elcoat, "The New Elcoat Electrode System", (8-page brochure).

*Primary Examiner*—Terryence Chapman

*Attorney, Agent, or Firm*—Bernard, Rothwell & Brown

[57] ABSTRACT

In a method and apparatus for electrocoating from an electrolyzing coating mixture, the temperature of a dialysis fluid is controlled to control the temperature of the coating mixture by heat exchange with the dialysis fluid while at the same time controlling the pH of the coating mixture by osmosis through a dialysis membrane. The flushing chamber and the electrode structure are formed by securing, in sealing relation, the membrane along all edges of one planar side of an electrically conductive sheet with all other surfaces of the sheet and structure not covered by the membrane being covered with an electrically non-conductive material. Central unsecured portions of the membrane are supported by spacers from the sheet surface to form a flushing chamber, and inlet and outlet means are provided through the sheet to enable a flow of dialysis fluid through the chamber sufficient to both cool and control the pH of the coating mixture.

15 Claims, 5 Drawing Figures

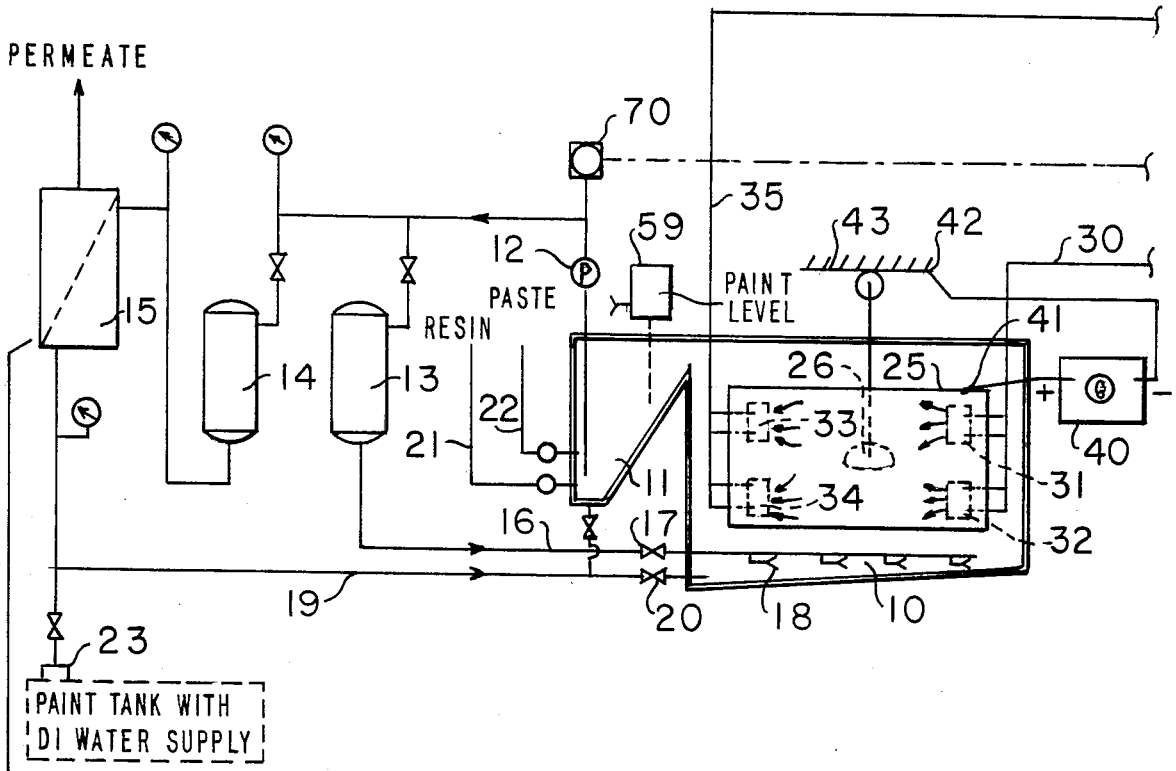
FIG. 1
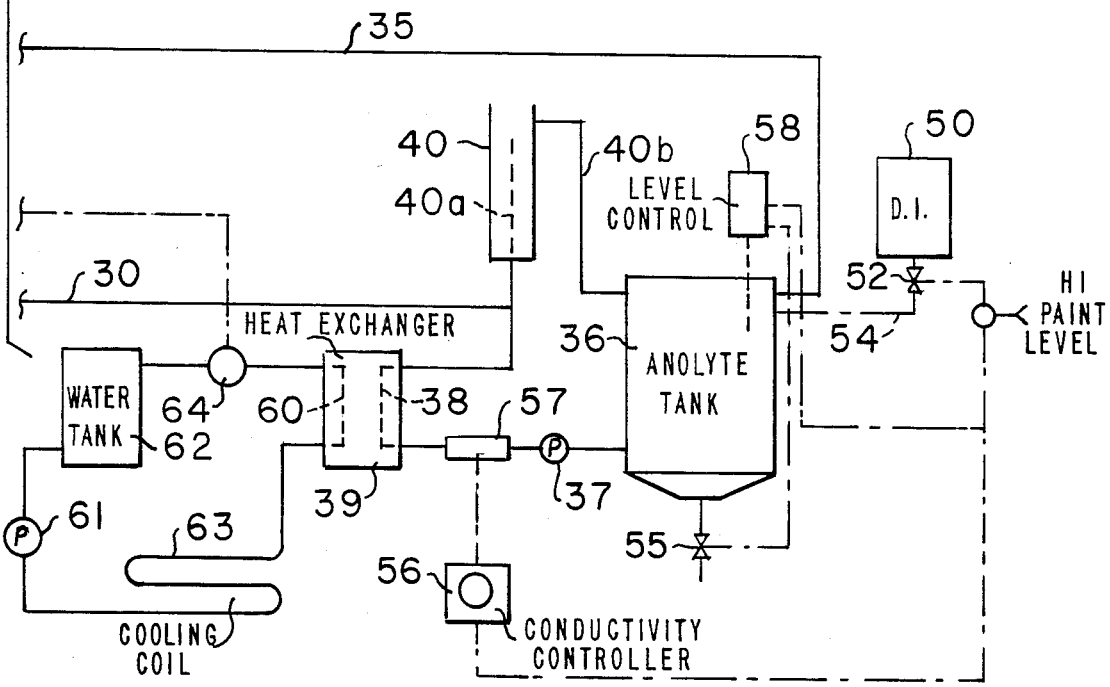

ELECTROCOATING METHOD AND APPARATUS

TECHNICAL FIELD

The present invention relates to coating methods and apparatus wherein electrodeposition of coating particles suspended in a bath, such as epoxy-phenolic resin or other heat curable, electrically depositable paint particles suspended in a water-based bath, is used to provide uniform coatings on surfaces of electrically conductive articles. After electrocoating, the coated articles are heated to coalesce and cure the coating.

DESCRIPTION OF THE PRIOR ART

The prior art contains both anodic and cathodic coating processes wherein the bath is agitated to avoid agglomeration of coating particles in the bath and wherein the pH and the temperature of the bath are also controlled. The pH of the coating mixture must be suitably controlled because of a variety of well known factors that affect the coating procedures including, the parameters of the particular coating mixtures used and the respective values of the applied electrical coating current. It is also important to maintain the temperature of the coating mixture to a desired value so that the function of the coating system and apparatus will not become impaired and the quality of the deposited coating will be maintained. The pH of the coating mixture is generally controlled by a dialysis fluid flow in a membrane electrode structure or cell, such as shown by U.S. Pat. No. 3,620,955 disclosing anodic deposition or U.S. Pat. No. 4,284,493 disclosing cathodic deposition, immersed in the coating fluid mixture in the coating tank. Generally, recirculation of the bath is used to provide agitation, and a heat exchanger in the bath recirculation stream, such as disclosed in U.S. Pat. No. 3,444,065, is used to maintain proper bath temperature. The prior art methods and apparatus are generally subject to inefficiencies including substantial downtime needed to clean unwanted deposits or accumulation of coating particles; the prior art heat exchangers are particularly subject to clogging by deposition and/or agglomoration of bath particles necessitating relatively frequent cleaning.

Additionally, prior art membrane electrode structures used in electrocoating generally include boxlike insulated frames supporting electrodes and membranes wherein the membranes extend across open faces of the frames to form chambers enclosing electrodes and through which the dialysis fluid is passed. These membrane electrode structures suffer from one or more deficiencies such as being relatively expensive, being subject to failure, tending to accumulate paint particle depositions, etc.

SUMMARY OF THE INVENTION

In accordance with this invention, a recirculating dialysis fluid flow is utilized for modifying and controlling the temperature of an electrolyzing coating bath in an electrocoating procedure in addition to the normal utilization of the dialysis fluid flow for pH control. The dialysis control of the pH of the coating fluid is conventionally obtained by osmosis of ions from the coating bath through a membrane enclosing a chamber through which the dialysis fluid flows, but in accordance with the present invention, the temperature of the coating mixture is now also modified or controlled by heat exchange through the membrane and modifying or controlling the temperature of the recirculation flow of the dialysis fluid through the chamber. Using the dialysis fluid for heat control of the coating bath eliminates the need for a heat exchanger in the coating bath recirculation stream as well as eliminating the problems associated with such a prior art heat exchanger.

Also, in accordance with the invention, the electrode membrane structure or electrode box is comprised of a membrane and associated electrode and is simply and relatively inexpensively constructed of a self-supporting conductive electrode of rigid metal sheet material having a flexible sheet membrane secured in sealed relation to all of its side edges in a manner to cover one planar side thereof. Means is provided to space the unsealed portions of the membrane from the covered side of the electrode sheet thus forming a flushing chamber for a substantial flow of dialysis or electrolyte fluid through suitable inlet and outlet means extending through the electrode sheet. All metal electrode sheet and structure surfaces not covered by the membrane are provided with an electrically insulating and non-conductive covering, but the metal electrode surface behind the membrane is uncovered and is thus arranged to be electrically contacted through the electrolytic dialysis fluid and membrane to an electrolyzing coating mixture in which it may be immersed.

In the preferred embodiment of this invention, the inlet and outlet means for the passage of dialysis fluid through the flushing chamber are arranged to cause a substantial flow of the dialysis fluid in the flushing chamber over a substantial area of the membrane and electrode surfaces to thus assure adequate heat exchange between the dialysis fluid and the coating mixture in the coating tank.

Other features and advantages of the invention will be apparent with reference to the following detailed description in connection with the drawings.

BRIEF DESCRIPTION OF DRAWINGS

FIG. 1 is a diagrammatic elevational layout of an electrocoating system and apparatus as it may be arranged to practice the invention;

DETAILED DESCRIPTION OF PREFERRED EMBODIMENTS

Figure 2:
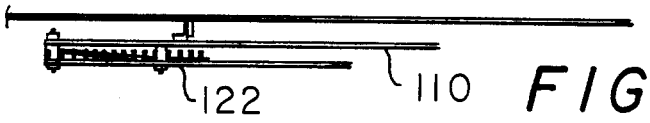
FIG. 2 is a top view of a side wall of a tank and a broken portion of a membrane and electrode structure of the apparatus of FIG. 1.
Figure 3:
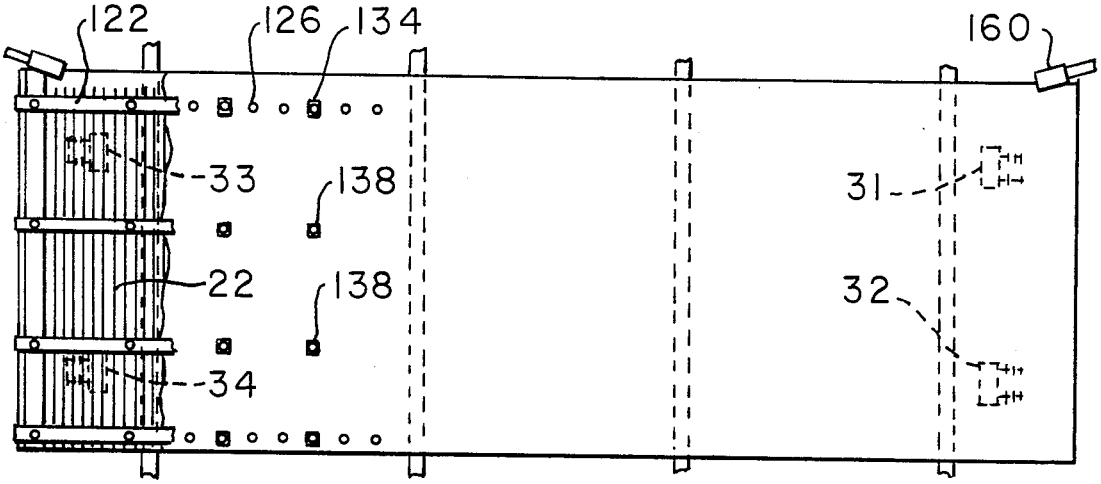
FIG. 3 is an elevational view of a membrane and electrode structure with portions broken away in the apparatus of FIG. 1.

It should be understood that this invention is useful for either anodic or cathodic electrocoating deposition depending upon the type of electrolyzing coating mixture to be used. As is well understood in the prior art, when cathodic deposition is used, the pH of the coating mixture is to be controlled by removal of negative ions from the coating mixture. When anodic deposition is to be used, the pH of the coating mixture may be controlled by removal of positive ions from the coating mixture. Thus, with either anodic or cathodic electrocoating depositions, the control or modification of the pH of the coating mixture in the present system is accomplished by osmosis of the desired ions from the coating mixture through the membrane into the dialysis fluid. The particular choice of dialysis fluid and the membrane will depend upon the choice of coating mixtures to be used and also the choice of either anodic or cathodic forms of coating deposition. Such choices are well known in the art and need not be further described herein.

For purposes of the detailed description of the invention, the use of cathodic coating deposition on the article will be described. Thus, an electrode membrane structure having an anode electrode and a membrane forming a flushing chamber through which a dialysis anolyte solution is flowed is described for removal and absorption of negative ions from the coating mixture to suitably modify or control its pH.

Referring to FIG. 1 of the drawing, a dip tank 10 for an electrolyzing coating mixture is provided with a Weir structure 11 to maintain a desired coating mixture (paint) level in the tank. The coating mixture is continuously circulated in a suitable manner from the Weir 11 and back to the tank 10 by means of a pump 12 through a loop including filters 13, 14 and 15. One portion of the coating mixture from the pump 12 is passed through the filter 13 and is returned through line 16 and control valve 17 to the tank 10 through a number of eductors in the bottom of the tank such as diagrammatically shown at 18 in a manner to provide a desired necessary agitation of the mixture in the tank. The remaining portion of the coating mixture from pump 12 is circulated through filters 14 and 15, the filter 15 being an ultrafilter producing a premeate flow which is passed to rinse facilities (not shown) or otherwise utilized or disposed of in a conventional manner. From the filter 15, the mixture is returned to the tank 10 through the line 19 and valve 20. Additionally, conventional resin and paste supply facilities 21 and 22 and conventional deionized water supply facilities 23 are provided to replenish the coating mixture. The water facilities 23 can utilize a storage tank through which coating mixture is circulated and wherein deionized water can be added when necessary.

Disposed within the tank 10 in a manner to be immersed in the coating mixture below the level maintained by the Weir 11, is at least one electrode membrane box structure 25 of the invention. In the preferred arrangement, at least two electrode membrane boxes are positioned along the respective opposite sides of the tank 10 so that an object 26 to be coated may be dipped in the coating mixture between oppositely positioned electrode membrane structures. Each electrode membrane structure is provided with an ion-transparent membrane shown at 120 in connection with FIGS. 2–5 of the drawings. A flushing chamber generally designated at 140 is formed between the membrane and electrode.

A suitable dialysis fluid is circulated from inlet line 30 through inlet structures 31, 32 into the flushing chamber 140 and across the inner electrode and the membrane surfaces through the outlet structures 33, 34 and to the outlet line 35. It is a feature of the invention that the inlets 31, 32 and outlets 33, 34 are of such numbers and size and are so positioned and arranged as to provide a substantial flow of dialysis fluid through the flushing chamber in contact with a substantial area of membrane and electrode structure to thus obtain a substantial heat exchange with the coating mixture in the tank 10 while removing negative ions through the membrane to control the pH of the coating mixtures. During the coating process, the temperature of the coating mixture tends to rise due to such factors as friction in the pump 12 and the heating due to the passage of electric current in the coating mixture between the article to be coated 26 and the electrode structure 25. This necessitated the prior art inclusion of a heat exchanger in the paint bath circulation stream. The prior art volume of flow of dialysis fluid within the prior art membrane structure was generally only sufficient to provide satisfactory ion removal, and was substantially less than the present volume of flow which is calculated in accordance with well known principles to provide the needed heat exchange. The present volume of flow is in the range from 3 to 10 or more times the prior art flow for a similar sized prior art coating system. Both the prior art and present volumes of flow vary in accordance with different sizes of baths, different coating materials, different coating rates, and other coating process factors affecting pH and temperature of the bath.

Since cathodic electrocoating is now being specifically described, a direct current power supply 40 is shown to have its positive terminal connected at 41 to the electrode of the electrode membrane structure 25 and its negative terminal connected at 42 to the article conveyor 43 and article 26 as generally shown. The applied potential and the current flow for the coating process is adapted to be controlled by any suitable well-known circuit arrangements (not shown) in order to control the coating depth, uniformity, etc., as is well-known for a given coating mixture.

Means to flow a dialysis fluid, which in the case of cathodic deposition may be an anolyte solution, includes the inlet line 30 and the outlet line 35. The inlet line 30 is connected to the dialysis fluid storage tank 36 by circulating pump 37 through a heat exchange coil 38 of heat exchanger 39 to a stand pipe 40. An open portion 40a of the inlet pipe 30 in the stand pipe 40 is provided with a sufficient length to control the pressure of the dialysis fluid (anolyte solution) in the line 30 and the flushing chamber of the electrode membrane structure 25 in a manner to prevent rupture of the membrane. Overflow pipe 40*b* returns excess dialysis fluid from the standpipe 40 to the storage tank 36. In place of the standpipe 40, other arrangements for controlling the pressure in the electrode membrane structure 25 may be used, as will occur to those skilled in the art.

For purposes of controlling the conductivity or ion absorptivity of the dialysis fluid, which in the embodiment of the invention being particularly described is an anolyte solution, a source of deionized water 50 is connected by valve 52 to line 54 connected with the dialysis fluid storage tank 36. A dialysis fluid waste discharge valve 55 is also connected to tank 36. The valve 52 is operated to add deionized water to the anolyte tank 36 either by a conductivity controller 56 sensing a high anolyte conductivity by conductivity cell 57 or by a level control 58 sensing a low liquid level in tank 36. The discharge valve 55 is operated by a high liquid level sensed by the level control 58 to withdraw spent anolyte which is passed back to a deionization facility (not shown) or to other utilization or disposal facility (not shown). During an initial startup, acetic acid may be added to the deionized water in the anolyte system to provide proper conductivity, e.g. 400 micromhos. The deionized water solenoid valve 52 is also interlocked with a paint level control 59 to prevent solenoid operation when the control 59 senses an excessively high paint level to prevent coating tank overflow in case of a membrane rupture.

As previously mentioned, a very important feature of this invention is to modify the temperature of the coating mixture by modifying the temperature of the dialysis fluid. For this purpose, the temperature of the dialysis fluid in the heat exchange coil 38 is suitably modified by the temperature of a heat exchange fluid in the coil 60 connected in circuit with a pump 61, fluid storage tank 62, and other heat exchange coil 63 through a flow restrictor valve 64. In the specific embodiment being described, the heat exchange fluid that is stored in the tank 62 is water, which may be chilled by flow through the underground cooling coil 63 of suitable length. Obviously, other arrangements for circulating a temperature modifying fluid through the coil 60 of the heat exchanger 39 may be used.

Considering the system of the invention as thus far described, it will be seen that a first coating mixture circulation loop, a second dialysis fluid circulation loop, and third temperature modifying heat exchange fluid circulating loop have been described.

In order that the temperature of the coating mixture may be modified to provide a desired suitable temperature thereof in the coating tank 10 during coating operations, a temperature responsive controller means 70 is arranged to respond to the temperature of the coating mixture discharged from the circulation pump 12 and control the operation of the flow restrictor valve 64 in the cooling medium coil of the heat exchanger 39. Various forms of temperature controllers are well known in the art and the details of such controller need not be described herein except to note that the flow restricting valve 64 may be preferably electrically operated and controlled by an electrical form of controller 70. Thus, the temperature of the dialysis fluid (anolyte solution) passing through the heat exchanger coil 38 to the flushing chamber of the membrane electrode structure is modified to maintain a desired temperature of coating mixture in the tank 10.

Referring now to FIGS. 2–5 of the drawings, the electrode membrane structure is shown to be simply comprised of an electrode sheet metal structure 110, preferably of stainless steel, having sufficient thickness and rigidity to be self-supporting and provide the main structural strength of the electrode membrane structure. The sheet membrane 120 is secured in sealing relationship over one planar surface or face of the sheet 110 around the sides of the one planar surface of the metal sheet, to thus form the flushing chamber 140 in the space between the unsecured portions of the membrane 120 and to the one planar surface 110*a* of the sheet 110. Stainless steel bolts 126 and nuts 126*a*, coated with an insulating film (not shown) such as an epoxy phenolic film, secure backing strips of suitable electrically non-conductive material 128 and rubber strips 130 to seal the edges of the membrane 120 to the edges of one planar side of the electrode sheet 110. At spaced intervals, the bolts 126 are replaced by fiber bolts such as shown at 134, together with fiber nuts 134*a* securing the outer edge seal. The fiber bolts 134 are extended as shown with distal nuts 134*a* to secure a protective grid 122 formed of insulating material such as fiberglass. The protective grid serves to prevent articles coated from accidentally striking and tearing the membrane 120 on the electrode sheet 110. The central portion of the membrane 120 is held spaced from the opposing central portion of the planar surface 110*a* of the electrode sheet 110 by means of threaded stainless steel spacer collars or nuts 138 welded or otherwise secured to the plate 110 at points spaced over the surface 110*a*. Fiber bolts 136 have one threaded end secured in the threaded collars 136 and have opposite threaded ends with fiber nuts 136*a* securing the grid 122. The grid 122 has internal shoulders 122*a* compressing insulative or polyvinyl chloride washers 135 against the outer surface of the member 120 over the spacers 138 to seal the membrane where the bolts 136 pass therethrough. Thus the center portion of the membrane is supported in spaced relationship from the plate to form the flushing chamber 140 between the opposing surfaces of the electrode 110 and membrane 120.

Figure 4:
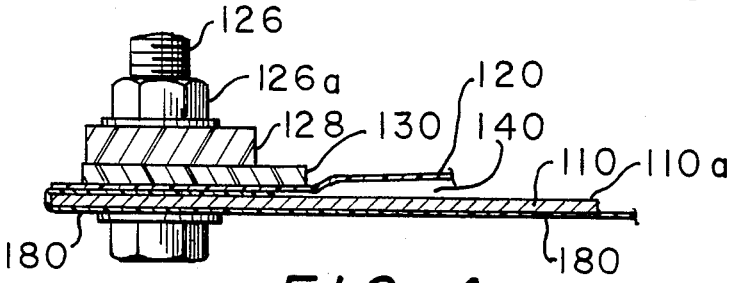
FIG. 4 is a detailed, fragmentary cross-section of a portion of a side edge of the electrode membrane structure to show the manner of securing the membrane in sealed relation to the electrode.
Figure 5:
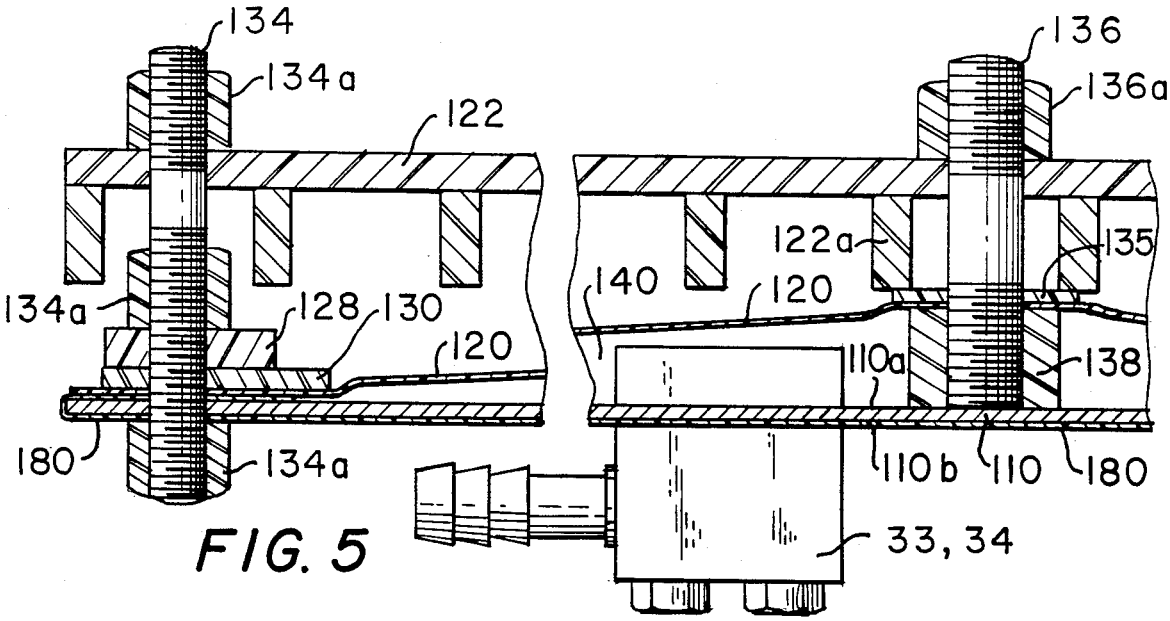
FIG. 5 is a detailed fragmentary cross-section of a side and inner portion of the electrode membrane structure to show the means for spacing the membrane from the electrode sheet surface to thus form a flushing chamber for dialysis fluid.

As shown most clearly by the fragmentary sectional views of FIGS. 4 and 5, the inner planar surface 110*a* of the electrode sheet 110 is electrically exposed while its outer planar surface and all other surfaces not covered by the membrane are covered by a non-conductive insulating covering 180. By way of example, the insulation covering 180 may be an electrically non-conductive coating of epoxy-phenolic film or the like. Thus, all surface portions of the electrode membrane structure are electrically non-conductive except for the electrically exposed inner planar electrode surface 110*a* that is covered by the membrane 120. In order to provide for a low of dialysis fluid through the flushing chamber 140, inlets 31, 32 and outlets 33, 34, also shown by FIG. 1, are provided. These inlet and outlet blocks may be formed of any suitable electrically-non-conductive plastic material such as polyvinyl chloride and extend through the electrode sheet 110 into the flushing chamber 140. An electric terminal 160 is provided to which a power supply may be connected with desired polarity and potential. The outer surfaces of the electrode terminal 160 are also covered by an electrically non-conductive material in any suitable manner obvious to those skilled in the art.

It is particularly noted that the membrane electrode structure is relatively planar without any surrounding frame structure to impede coating mixture flow. Also the grid structure 122 is spaced from the membrane electrode structure to avoid inhibiting coating mixture flow over the membrane electrode structure. Thus tendencies for paint particle accumulations on the membrane electrode and grid structures are substantially reduced.

The manner of practising the method and using the apparatus of the invention should now be readily apparent to those skilled in the art. By way of example only, and not to limit the invention in any manner, the type of electrolyzing coating mixture or paint for cathodic electrocoating was determined to be such as to require a control of the mixture temperature to about 82°±1° F. The pH of the mixture was desirably controlled by maintaining the electrical conductivity of the dialysis solution to about 400 microhms per centimeter. The applied voltage from the direct current power supply was determined to be about 300–500 volts, depending upon the desired coating thickness on the article.

Since many modifications, variations and changes in detail may be made to the above described embodiment without departing from the scope and spirit of the invention, it is intended that all matter described in the foregoing description and shown in the drawings be interpreted as only illustrating, and not as limiting, the invention defined in the following claims.

What is claimed is:

1. A method for electrocoating by electrodeposition of a coating on an electrically conductive article to be coated, comprising the steps of:

immersing the article in a coating tank containing a circulating electrolyzing liquid coating mixture and an electrode covered by a membrane also immersed in the coating mixture, continuously circulating an electrolytic ion absorbing dialysis fluid between the membrane and electrode to modify the pH of the coating mixture, establishing an electrical potential difference between the article and the electrode to cause a direct current to flow through the electrolytic dialysis fluid and the coating mixture to the article and thereby deposit a coating on the article, and modifying the temperature of the dialysis fluid to thereby modify the temperature of the coating mixture while coating.

2. The method of claim 1 for which the potential difference is established with positive polarity on the electrode and with negative polarity on the article, said dialysis fluid being an anolyte solution to thereby absorb negative ions from the coating mixture and modify the pH of the coating mixture.

3. The method of claim 2 for which the anolyte solution is comprised of a mixture of de-ionized water and acetic acid having a desired value of electrical conductivity.

4. The method of claim 1 including the step of measuring the temperature of the coating mixture and wherein the step of modifying the temperature of the dialysis fluid is performed in accordance with the measured temperature in order to maintain a desired temperature of coating mixture.

5. The method of claim 1 wherein the step of modifying the temperature of the dialysis fluid is performed by circulating the dialysis fluid through a heat exchanger where heat exchange with a cooling water flow is used to modify the temperature of the dialysis fluid.

6. The method of claim 5 including the step of measuring the temperature of the coating mixture, and wherein the step of modifying the temperature of the dialysis fluid includes varying the cooling water flow in accordance with the measured temperature to maintain a desired temperature of the coating mixture.

7. The method of claim 5 including a step of withdrawing a portion of the circulating dialysis fluid, and a step of replacing the withdrawn portion with deionized water to maintain ion absorptivity of the circulating dialysis fluid.

8. Electrocoating apparatus comprising, a coating tank adapted to contain an electrolyzing liquid coating mixture for electrocoating on an electrically conductive article immersed in the mixture, means for continuously circulating said mixture through said tank during coating, an electrode membrane structure adapted to be submerged in the coating mixture in said tank and having an electrode covered by an ion-selective membrane over an electrically exposed surface thereof to form a flushing chamber between the membrane and electrically exposed electrode surface, means for continuously circulating an ion-absorbing dialysis fluid through said flushing chamber to thereby modify the pH of the coating mixture during coating, means to modify the temperature of said circulating dialysis fluid during coating to modify the temperature of said coating mixture, and a power supply connected to apply a potential difference between said electrode and article to be coated to thus establish an electrolyzing current and deposit a coating on said article 9. The apparatus of claim 8 in which said electrocoating is cathodic and the positive terminal of said power supply is connected to said electrode while the negative power supply terminal is connected to said article.

10. The apparatus of claim 9 in which said dialysis fluid is an anolyte solution of de-ionized water and acetic acid having a desired electrical conductivity.

11. The apparatus of claim 8 in which the means to modify the temperature of the dialysis fluid is a temperature modifying fluid, the apparatus further comprising a heat exchanger, and means connecting said dialysis fluid and said temperature modifying fluid through said heat exchanger in heat exchange relation to each other.

12. The apparatus of claim 11 in which means is provided to measure the temperature of said coating mixture, and means responsive to said measured temperature is provided to control the flow of temperature modifying fluid through said heat exchanger to thus modify the temperatures of said dialysis fluid and thus said coating mixture in accordance with the measured temperature.

13. An electrocoating system comprising, a first loop for continuously circulating an electrolyzing coating mixture through a coating tank, a second loop for continuously circulating a dialysis fluid through a flushing chamber formed of a membrane sealed at its edges to an electrode plate and submerged in the coating mixture in the coating tank, and a third loop for continuously circulating a temperature modifying fluid in heat exchange relation to the dialysis fluid in the second loop before it passes ito said flushing chamber to thereby modify the temperature of the coating mixture in the tank.

14. The system of claim 13 in which said second loop is provided with means to limit the pressure of dialysis fluid flowing through said flushing chamber.

15. The system of claim 13 in which said second loop is provided with means to maintain the electrical conductivity of the dialysis fluid at a desired amount.

* * * * *